US007313997B2

(12) United States Patent
Bin et al.

(10) Patent No.: US 7,313,997 B2
(45) Date of Patent: Jan. 1, 2008

(54) COPPER ALLOY PISTON SHOE

(75) Inventors: Feng Bin, Canton, MI (US); Pete Edward Ganster, Plymouth, MI (US); Michael Gregory Theodore, Jr., Plymouth, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 11/441,953

(22) Filed: May 26, 2006

(65) Prior Publication Data

US 2007/0272076 A1 Nov. 29, 2007

(51) Int. Cl.
*F01B 3/00* (2006.01)

(52) U.S. Cl. ..... 92/71; 92/155

(58) Field of Classification Search ..... 92/12.2, 92/71, 155; 91/499, 505; 417/269
See application file for complete search history.

(56) References Cited

U.S. PATENT DOCUMENTS

| | | | | |
|---|---|---|---|---|
| 3,641,829 | A | 2/1972 | Reynolds | |
| 4,244,679 | A | 1/1981 | Nakayama et al. | |
| 4,263,814 | A | 4/1981 | Takaoka et al. | |
| 4,285,640 | A | 8/1981 | Mukai | |
| 4,307,998 | A | 12/1981 | Nakayama et al. | |
| 4,617,856 | A | 10/1986 | Miller et al. | |
| 4,683,803 | A | 8/1987 | Miller et al. | |
| 4,732,047 | A * | 3/1988 | Kato et al. | 74/60 |
| 5,038,673 | A | 8/1991 | Schulze | |
| 5,056,417 | A | 10/1991 | Kato et al. | |
| 5,380,167 | A * | 1/1995 | Burkett et al. | 92/71 |
| 5,589,652 | A | 12/1996 | Arato et al. | |
| 5,655,432 | A | 8/1997 | Wilkosz et al. | |
| 5,704,272 | A | 1/1998 | Durako et al. | |
| 5,809,863 | A | 9/1998 | Tominaga et al. | |
| 5,864,745 | A | 1/1999 | Kawagoe et al. | |
| 5,974,946 | A | 11/1999 | Kanou et al. | |
| 6,142,060 | A | 11/2000 | Saito et al. | |
| 6,435,047 | B1 | 8/2002 | Kitagawa et al. | |
| 6,532,664 | B1 | 3/2003 | Kitagawa et al. | |
| 6,582,200 | B2 * | 6/2003 | Kato et al. | 92/71 |
| 6,662,709 | B1 | 12/2003 | Beutler | |
| 6,840,696 | B1 | 1/2005 | Donders | |
| 6,877,418 | B2 | 4/2005 | Ishizaki | |
| 2003/0106425 | A1 | 6/2003 | Kuribara | |

* cited by examiner

*Primary Examiner*—Michael Leslie
(74) *Attorney, Agent, or Firm*—Fraser Clemens Martin & Miller LLC; J. Douglas Miller

(57) ABSTRACT

A swash plate type compressor is disclosed, wherein a shoe, having a first surface slidably disposed on a swash plate and a second surface received in a pocket formed in a piston, is formed from a copper alloy.

13 Claims, 2 Drawing Sheets

COPPER ALLOY PISTON SHOE

FIELD OF THE INVENTION

The invention relates to a swash plate type compressor and more particularly to piston shoes formed from a copper alloy for the swash plate type compressor.

BACKGROUND OF THE INVENTION

A swash plate type compressor is typically used in an air conditioning system for a vehicle. The swash plate type compressor includes a plurality of pistons that are slidably fitted into a plurality of bores disposed in a cylinder block. A transmission of power is carried out as a swash plate secured to a rotary shaft rotates and causes the pistons to reciprocate in the bores. Reciprocation of the pistons causes suction, compression, and discharge of a gas.

Prior art swash plate compressors include a range of designs to transmit power from the rotating swash plate to the piston. One such design includes a swash plate having a slidably mounted pad on its surface. The pad contacts the outer surface of a spherical bearing that is operatively connected to the inner surface of a pocket of the piston. Alternate designs have been developed with the intention of using fewer components to reduce production cost.

One of these designs utilizes a shoe disposed on the face of the swash plate. The shoe includes a spherically shaped outer surface that fits into a concave pocket of the piston. This eliminates the need for the spherical bearing. Prior art compressors using the shoe design include a variety of materials to form the swash plates, the shoes, the balls, and the pistons. Problems associated with tribological mating of similar materials have necessitated that certain precautions be taken when selecting materials to form the components. One such precaution is the application of a solid lubricant coating between the metal components to avoid the mating of similar materials.

Metal coatings are commonly used to treat swash plate surfaces. U.S. Pat. No. 5,056,417 treats a swashplate body with a surface coating layer made of tin and at least one metal selected from the group consisting of copper, nickel, zinc, lead, and indium. U.S. Pat. No. 5,864,745 discloses flame sprayed copper based materials to coat swash plates.

Polymer based coatings have been suggested for coating aluminum swash plates, such as that disclosed in U.S. Pat. No. 5,655,432. The swash plate is treated with a coating of a mixture of cross-linked polyfluoro-elastomer bonded directly to the aluminum, a lubricious additive, and a load bearing additive such as boron carbide, for example. Polymer based coatings have less than desirable wear resistance due to soft physical characteristics, the polymer becomes even softer at higher temperatures.

The application of coatings increases the cost of production and the weight of the structure. The coatings can also reduce the strength of the compressor.

It would be desirable to produce a swash plate type compressor, whereby a cost of manufacture and a weight thereof are minimized, and a strength thereof is maximized.

SUMMARY OF THE INVENTION

Harmonious with the present invention, a swash plate type compressor, whereby a cost of manufacture and a weight thereof are minimized, and a strength thereof is maximized, has surprisingly been discovered.

In one embodiment, a swash plate type compressor comprises a housing including a cylindrical block; a swash plate rotatably mounted in the housing and supported by a rotatable drive shaft, the swash plate having a first substantially flat surface and a second substantially flat surface; at least one piston disposed in the cylinder block and having a first end including a pair of spaced apart pockets formed therein; and a pair of shoes having a first surface and a second surface, the first surface slidably engaging one of the first surface and the second surface of the swash plate, the second surface received in one of the pockets of the piston, the shoe facilitating a slanting of the swash plate and a transfer of rotation of the swash plate to a reciprocating motion of the piston, at least a portion of the shoe including the first surface formed from a copper alloy.

In another embodiment, a swash plate type compressor comprises a housing including cylindrical block; a swash plate rotatably mounted in the housing and supported by a rotatable drive shaft, the swash plate having a first substantially flat surface and a second substantially flat surface; at least one piston disposed in the cylinder block and having a first end including a pair of spaced apart pockets formed therein; and a pair of shoes having a first portion and a second portion, the first portion having a first surface slidably engaging one of the first surface and the second surface of the swash plate and a second surface adapted to be received by the second portion, the second portion having a first surface adapted to receive the second surface of the first portion and a second surface received in one of the pockets of the piston, the shoe facilitating a slanting of the swash plate and a transfer of rotation of the swash plate to a reciprocating motion of the piston, at least the first portion of the shoe being formed from a copper alloy.

In another embodiment, a swash plate type compressor comprises a housing including a cylindrical block; a swash plate formed from steel and rotatably mounted in the housing and supported by a rotatable drive shaft, the swash plate having a pair of spaced apart substantially flat surfaces; at least one piston disposed in the cylinder block and having a pair of spaced apart pockets formed in a first end thereof; and a pair of shoes having a first surface and a second surface, the first surface slidably engaging one of the surfaces of the swash plate, the second surface received in one of the pockets of the piston, the shoe facilitating a slanting of the swash plate and a transfer of rotation of the swash plate to a reciprocating motion of the piston, the shoe formed from a copper alloy.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
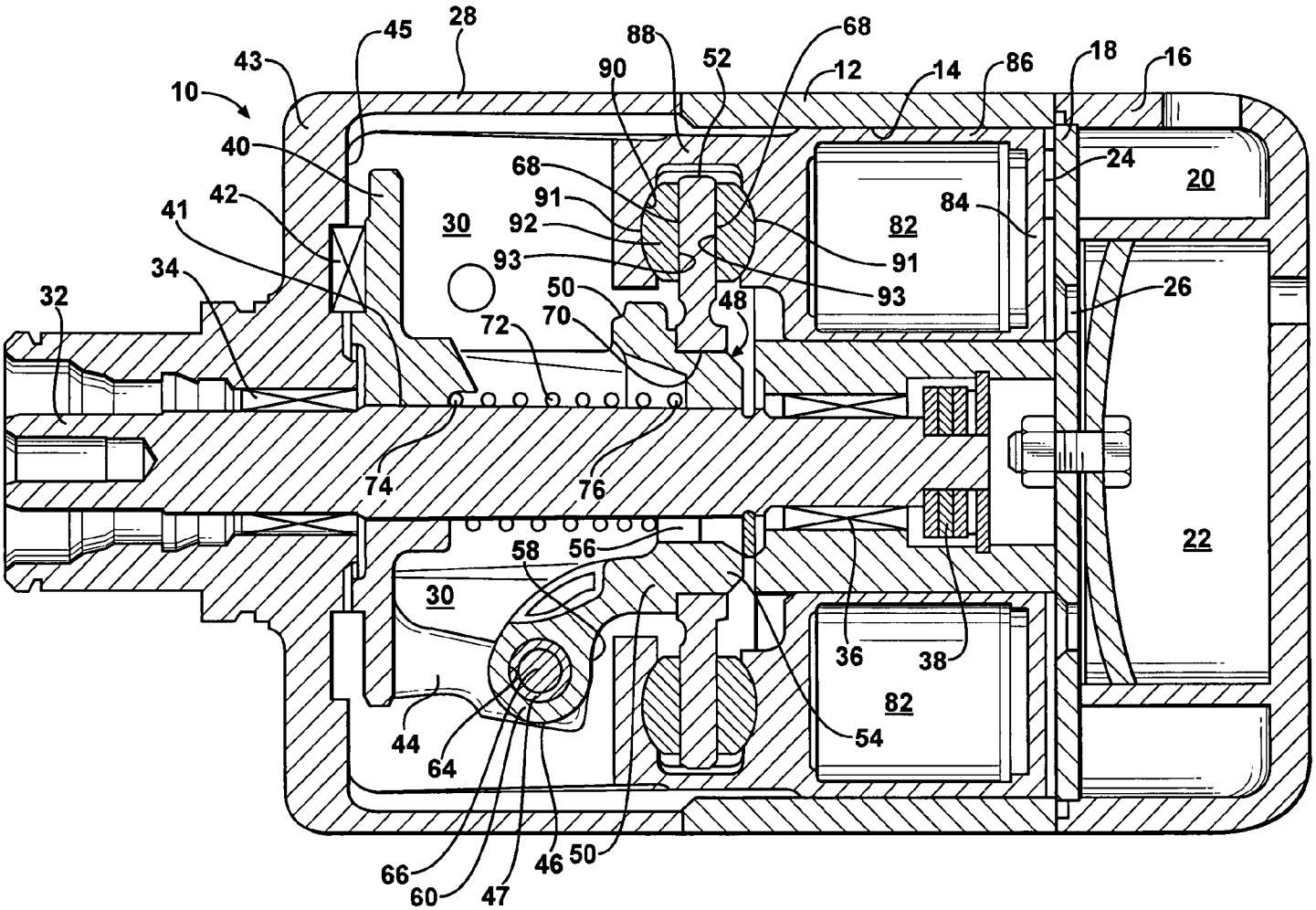
FIG. 1 shows a sectional view of a variable displacement swash plate-type compressor in accordance with an embodiment of the invention.

The following detailed description and appended drawings describe and illustrate various exemplary embodiments of the invention. While a variable displacement swash plate-type compressor is shown in the drawings and described below, it is understood that other swash plate-type compressors can be used without departing from the spirit or scope of the invention. Additionally, although use with a single ended piston is described herein, it is understood the invention can be used with a double ended piston, if desired. The description and drawings serve to enable one skilled in the art to make and use the invention, and are not intended to limit the scope of the invention in any manner.

FIG. 1 shows a variable displacement swash plate-type compressor 10. The compressor 10 includes a cylinder block 12 having a plurality of cylinders 14 formed therein. A head 16 is disposed adjacent one end of the cylinder block 12 and sealingly closes the end of the cylinder block 12. A valve plate 18 is disposed between the cylinder block 12 and the head 16. The head 16 includes a suction chamber 20 and a discharge chamber 22. The suction chamber 20 communicates with the cylinders 14 through a suction port 24. The cylinders 14 communicate with the discharge chamber 22 through a discharge port 26 disposed in the valve plate 18. A crankcase 28 is sealingly disposed at the other end of the cylinder block 12. The crankcase 28 and cylinder block 12 cooperate to form an airtight crank chamber 30.

A drive shaft 32 is centrally disposed in and extends through the crankcase 28 to the cylinder block 12. The drive shaft 32 is rotatably supported by a bearing 34 mounted in the crankcase 28 and a bearing 36 mounted in the cylinder block 12. Longitudinal movement of the drive shaft 32 is restricted by a thrust bearing 38 mounted in the cylinder block 12.

A rotor 40 is fixedly mounted within the crank chamber 30 on an outer surface 41 of the drive shaft 32 adjacent a first end 43 of the crankcase 28. A thrust bearing 42 is mounted in the crank chamber 30 on an inner wall 45 of the crankcase 28 and disposed between the crankcase 28 and the rotor 40. The thrust bearing 42 provides a bearing surface for the rotor 40. An arm 44 extends laterally outwardly from a surface of the rotor 40 opposite the surface of the rotor 40 that contacts the thrust bearing 42. A slot 46 is formed in the distal end of the arm 44. A pin 47 has a first end (not shown) slidingly disposed in the slot 46 of the arm 44 of the rotor 40.

A swash plate 48 includes a hub 50 and an annular plate 52. As is known in the art, the hub 50 and annular plate 52 may be formed separately or as an integral piece. The hub 50 includes a hollow, cylindrical main body 54 having a central aperture 56 that receives the drive shaft 32. An arm 58 extends radially outwardly from the main body 54. A distal end 60 of the arm 58 includes an aperture 64 that receives a second end 66 of the pin 47.

The annular plate 52 has a pair of opposed, substantially flat surfaces 68 and a central aperture 70 formed therein. The main body 54 of the hub 50 is inserted into the aperture 70 of the annular plate 52 to form the swash plate 48.

A coil spring 72 is disposed around the outer surface of the drive shaft 32. A first end 74 of the spring 72 abuts the rotor 40 and a spaced apart second end 76 of the spring 72 abuts the hub 50.

A plurality of pistons 82 is slidably disposed in the cylinders 14 in the cylinder block 12. Each of the pistons 82 includes a head 84 and a skirt portion 86 that terminates in a bridge portion 88.

Figure 2:
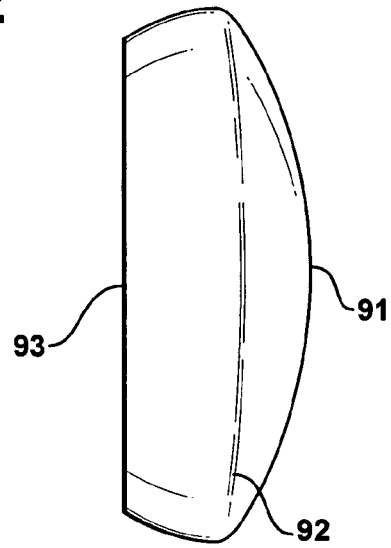
FIG. 2 shows a side elevational view of a shoe for the swash plate-type compressor illustrated in FIG. 1.

A pair of concave shoe pockets 90 is formed in the bridge portion 88 of each piston 82 for supporting a pair of semi-spherical shoes 92. The shoes 92, which are more clearly shown in FIG. 2, include a first surface 91 that is semi-spherical and a second surface 93 that is substantially flat. The spherical surfaces 91 of the shoes 92 are rotatably disposed in the shoe pockets 90 of the bridge portion 88. The substantially flat surfaces 93 of the shoes 92 slidably engage the substantially flat surfaces 68 of the annular plate 52 of the swash plate 48. The shoes 92 are formed from a copper alloy. In the embodiment shown, the copper alloy is a high strength alloy having a hardness of at least Rockwell B 60, although other copper alloys can be used as desired. The composition of the high-strength copper alloy includes a combination of least two of the following elements, in the ranges indicated: Cu (50-97%), Zn (0-45%), Sn (0-15%), Pb (0-15%), Ni (0-32%), and Mn (0-5%).

Operation of the compressor 10 is accomplished by rotation of the drive shaft 32 caused by an auxiliary drive means (not shown) such as an internal combustion engine of a vehicle, for example. Rotation of the drive shaft 32 causes a corresponding rotation of the rotor 40. The swash plate 48 is connected to the rotor 40 by a hinge mechanism formed by the pin 47 slidingly disposed in the slot 46 of the arm 44 of the rotor 40, and fixedly disposed in the aperture 64 of the arm 58 of the hub 50. As the rotor 40 rotates, the connection made by the pin 47 between the swash plate 48 and the rotor 40 causes the swash plate 48 to rotate. During rotation, the swash plate 48 is disposed at an inclination angle, which may be adjusted as is known in the art. The inclination angle of the swash plate 48, the sliding engagement between the annular plate 52 and the shoes 92, and the rotation of the shoes 92 in the pockets 90 of the bridge portion 88 of the pistons 82 causes a reciprocation of the pistons 82. Because of the spherical shape of the surfaces 93, the shoes 92 rotatably fit into the shoe pockets 90 of the bridge portion 88 of the pistons 82, and remain disposed in the shoe pockets 90 regardless of the inclination angle of the swash plate 48.

Due to tribological concerns, a material mating with steel is preferred to be a non-steel material. It is preferable to form the annular plate 52 from steel to maximize a useful life thereof. Forming the shoes 92 from a copper alloy allows the annular plate 48 and the shoe pocket 90 of the piston 82 to be formed from steel. The use of a solid copper alloy formed shoe 92 also eliminates the need for the application of a metal or polymer based coating to the annular plate 48 or the shoes 92 as in prior art swash plate-type compressors having steel swash plates and shoes.

Figure 3:
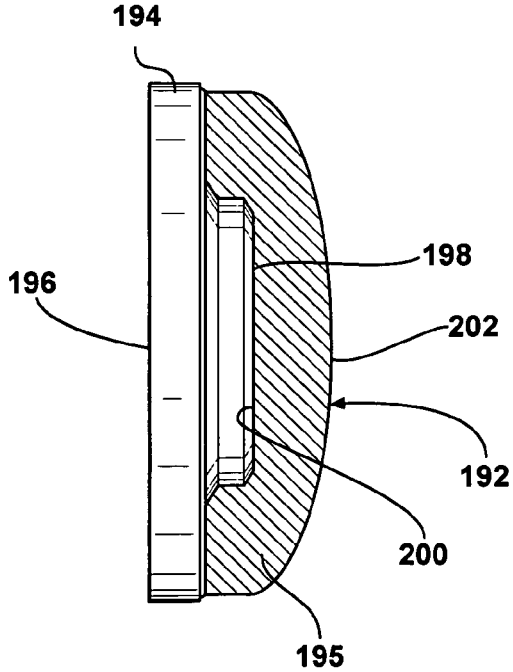
FIG. 3 shows a side sectional view of a shoe in accordance with another embodiment of the invention.

FIG. 3 shows a semi-spherical shoe 192 having a first portion 194 and a second portion 195 in accordance with another embodiment of the invention. In the embodiment shown, the first portion 194 of the shoe 192 is formed from a high-strength copper alloy having a hardness of at least Rockwell B 60, although other copper alloys can be used as desired. The composition of the high-strength copper alloy includes a combination of least two of the following elements in the ranges indicated: Cu (50-97%), Zn (0.1-45%), Sn (0.1-15%), Pb (0.1-15%), Ni (0.1-32%), and Mn (0.01-5%).

The first portion 194 of the shoe 192 includes a substantially flat first surface 196 that is adapted to slidably engage a substantially flat surface of an annular plate (not shown) as discussed above for FIGS. 1 and 2. The first portion 194 includes a second surface 198 that is adapted to be received by a first surface 200 of the second portion 195.

The second portion 195 can be formed from any conventional material as desired such as steel or a copper alloy, for example. The second portion 195 includes a semi-spherical second surface 202 that is rotatably disposed in a shoe pocket (not shown) of a piston (not shown) as described above for FIGS. 1 and 2.

Use of the shoe 192 is substantially the same as described above for FIGS. 1 and 2.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A swash plate type compressor comprising:

a housing including a cylinder block;

a swash plate rotatably mounted in said housing and supported by a rotatable drive shaft, said swash plate having a first substantially flat surface and a second substantially flat surface;

at least one piston disposed in the cylinder block, said piston including a pair of spaced apart pockets formed therein; and at least one shoe having a first portion and a second portion, the first portion having a first surface slidably engaging one of the first surface and the second surface of said swash plate and a second surface adapted to be received by the second portion, the second portion having a first surface adapted to receive the second surface of the first portion and a second surface received in one of the pockets of said piston, said shoe facilitating a slanting of said swash plate and a transfer of rotation of said swash plate to a reciprocating motion of said piston, at least the first portion of said shoe being formed from a copper alloy.

2. The compressor disclosed in claim 1, wherein the second surface of the second portion of said shoe is substantially spherical in shape.

3. The compressor disclosed in claim 1, wherein the second portion of said shoe is formed from steel.

4. The compressor disclosed in claim 1, wherein the copper alloy contains at least two elements from a group consisting of Cu, Zn, Sn, Pb, Ni, and Mn.

5. The compressor disclosed in claim 4, wherein a composition of the copper alloy contains at least two elements selected from the group consisting of Cu (50-97%), Zn (0-45%), Sn (0-15%), Pb (0-15%), Ni (0-32%), and Mn (0-5%), in the respective ranges indicated.

6. The compressor disclosed in claim 1, wherein said swash plate is formed from steel.

7. The compressor disclosed in claim 1, wherein the pockets of said piston are formed from steel.

8. The compressor disclosed in claim 1, wherein the second portion of said shoe is formed from a copper alloy.

9. A swash plate type compressor comprising:

a housing including a cylinder block;

a swash plate formed from steel and rotatably mounted in said housing and supported by a rotatable drive shaft, said swash plate having a pair of spaced apart substantially flat surfaces;

at least one piston disposed in the cylinder block, said piston including a pair of spaced apart pockets formed therein; and at least one shoe having a first surface and a second surface, the first surface slidably engaging one of the surfaces of said swash plate, the second surface received in one of the pockets of said piston, said shoe facilitating a slanting of said swash plate and a transfer of rotation of said swash plate to a reciprocating motion of said piston, said shoe formed from a copper alloy.

10. The compressor disclosed in claim 9, wherein the second surface of said shoe is substantially spherical in shape.

11. The compressor disclosed in claim 9, wherein the copper alloy contains at least two elements from a group consisting of Cu, Zn, Sn, Pb, Ni, and Mn.

12. The compressor disclosed in claim 11, wherein a composition of the copper alloy contains at least two elements selected from the group consisting of Cu (50-97%), Zn (0-45%), Sn (0-15%), Pb (0-15%), Ni (0-32%), and Mn (0-5%), in the respective ranges indicated.

13. The compressor disclosed in claim 9, wherein the pockets of said piston are formed from steel.

* * * * *